US008989618B2

(12) United States Patent
Kawai et al.

(10) Patent No.: US 8,989,618 B2
(45) Date of Patent: Mar. 24, 2015

(54) CLEANING MEMBER FOR IMAGE FORMING APPARATUS, CHARGING DEVICE, UNIT FOR IMAGE FORMING APPARATUS, PROCESS CARTRIDGE, AND IMAGE FORMING APPARATUS

(75) Inventors: Takeshi Kawai, Kanagawa (JP); Fuyuki Kano, Kanagawa (JP); Makoto Nishimura, Kanagawa (JP); Makoto Takemoto, Mie (JP)

(73) Assignee: Fuji Xerox Co., Ltd., Tokyo (JP)

( * ) Notice: Subject to any disclaimer, the term of this patent is extended or adjusted under 35 U.S.C. 154(b) by 298 days.

(21) Appl. No.: 13/452,189

(22) Filed: Apr. 20, 2012

(65) Prior Publication Data

US 2013/0108311 A1 May 2, 2013

(30) Foreign Application Priority Data

Oct. 28, 2011 (JP) ..... 2011-237896

(51) Int. Cl.
*G03G 21/18* (2006.01)
*G03G 15/02* (2006.01)

(52) U.S. Cl.
CPC ..... *G03G 15/0225* (2013.01); *G03G 21/1814* (2013.01)
USPC ..... 399/100; 399/357

(58) Field of Classification Search
CPC ..... G03G 15/0225; G03G 21/18
USPC ..... 399/100, 357
See application file for complete search history.

(56) References Cited

U.S. PATENT DOCUMENTS

| | | | | |
|---|---|---|---|---|
| 2011/0170900 | A1 | 7/2011 | Suto | |
| 2011/0170901 | A1* | 7/2011 | Kawai et al. | 399/100 |
| 2011/0318047 | A1* | 12/2011 | Nonaka et al. | 399/100 |

FOREIGN PATENT DOCUMENTS

| | | |
|---|---|---|
| JP | A-02-272594 | 11/1990 |
| JP | A-07-129055 | 5/1995 |
| JP | A-07-219313 | 8/1995 |
| JP | A-2001-209238 | 8/2001 |
| JP | A-2005-030100 | 2/2005 |
| JP | A-2011-145409 | 7/2011 |
| JP | A-2011-145412 | 7/2011 |

* cited by examiner

*Primary Examiner* — Ryan Walsh
*Assistant Examiner* — Philip Marcus T Fadul
(74) *Attorney, Agent, or Firm* — Oliff PLC

(57) ABSTRACT

A cleaning member for an image forming apparatus includes a core member, a foamed elastic layer in which two or more strip-shaped foamed elastic members connected together at one or both of longitudinal end portions are spirally wound around the outer peripheral surface of the core member from one end of the core member to the other end thereof, and an adhesive layer for bonding the core member and the foamed elastic layer together.

10 Claims, 10 Drawing Sheets

CLEANING MEMBER FOR IMAGE FORMING APPARATUS, CHARGING DEVICE, UNIT FOR IMAGE FORMING APPARATUS, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2011-237896 filed Oct. 28, 2011.

BACKGROUND (i) Technical Field

The present invention relates to a cleaning member for an image forming apparatus, a charging device, a unit for an image forming apparatus, a process cartridge, and an image forming apparatus.

(ii) Related Art

In image forming apparatuses using an electrophotographic system, first, the surface of an image holding member including a photoreceptor or the like is charged by a charging device to form charges, and an electrostatic latent image is formed with a laser beam or the like obtained through modulation of an image signal. Thereafter, a toner image visualized by developing the electrostatic latent image by a charged toner is formed. Then, the toner image is electrostatically transferred to a member to be transferred, such as a recording paper, via an intermediate transfer member, or directly is fixed onto the member to be transferred to obtain an image.

SUMMARY

According to an aspect of the invention, there is provided a cleaning member for an image forming apparatus including a core member; a foamed elastic layer in which two or more strip-shaped foamed elastic members connected together at one or both of longitudinal end portions are spirally wound around the outer peripheral surface of the core member from one end of the core member to the other end thereof; and an adhesive layer for bonding the core member and the foamed elastic layer together.

BRIEF DESCRIPTION OF THE DRAWINGS

Exemplary embodiments of the present invention will be described in detail based on the following figures, wherein.

DETAILED DESCRIPTION

Figure 1:
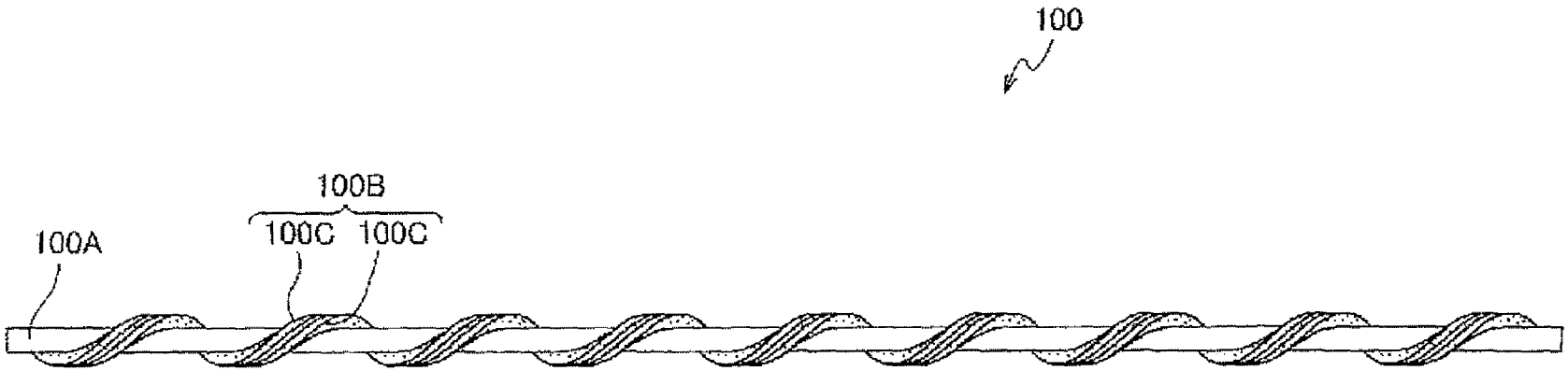
FIG. 1 is a schematic configuration view showing a cleaning member for an image forming apparatus related to the present exemplary embodiment.

An exemplary embodiment that is an example of the invention will be described below. In addition, members that have the same functions and effects are designated by the same reference numerals throughout the drawings, and the description thereof may be omitted.

Cleaning Member

Figure 2:
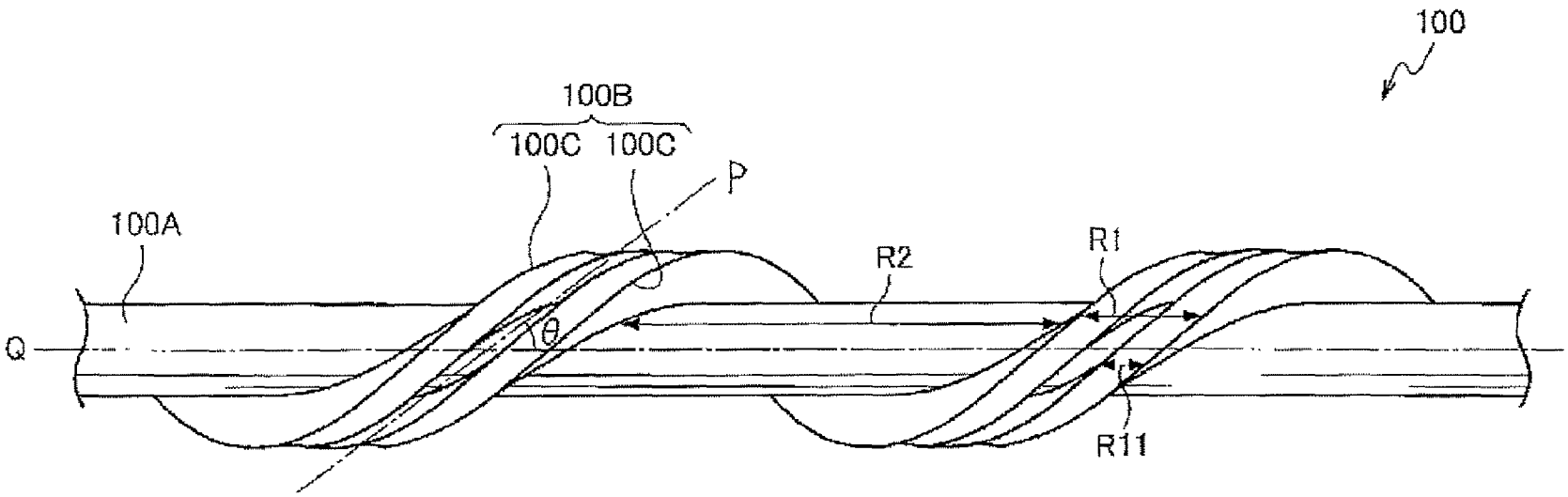
FIG. 2 is a schematic partial enlarged view of the cleaning member for an image forming apparatus related to the present exemplary embodiment.
Figure 3A:
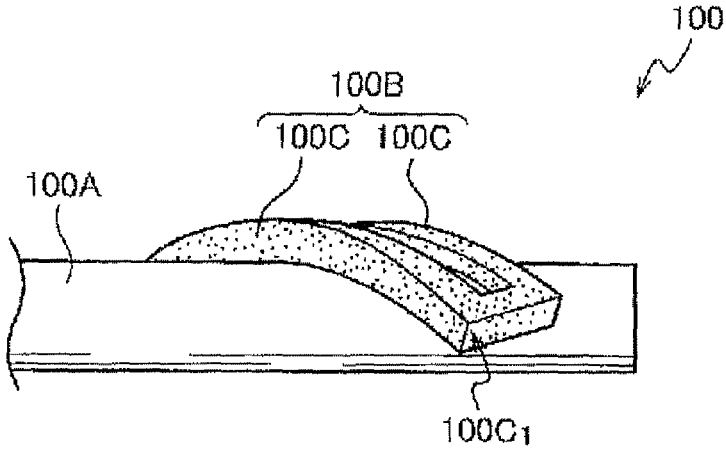
FIGS. 3A to 3C are schematic perspective views showing one longitudinal end portion of the cleaning member for the image forming apparatus related to the present exemplary embodiment.
Figure 3B:
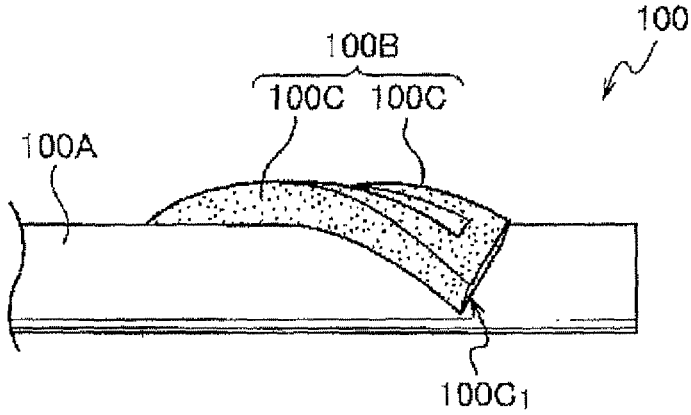
Figure 3C:
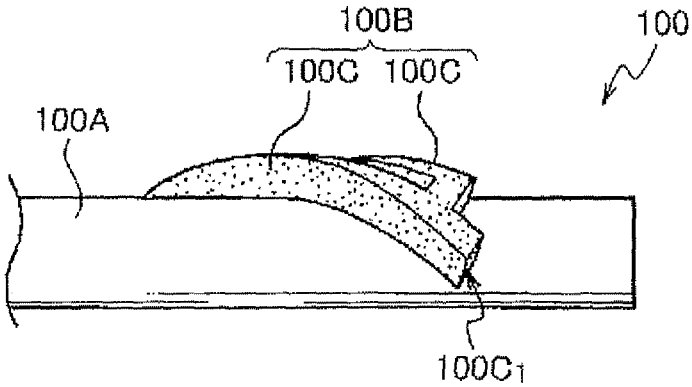
Figure 4:
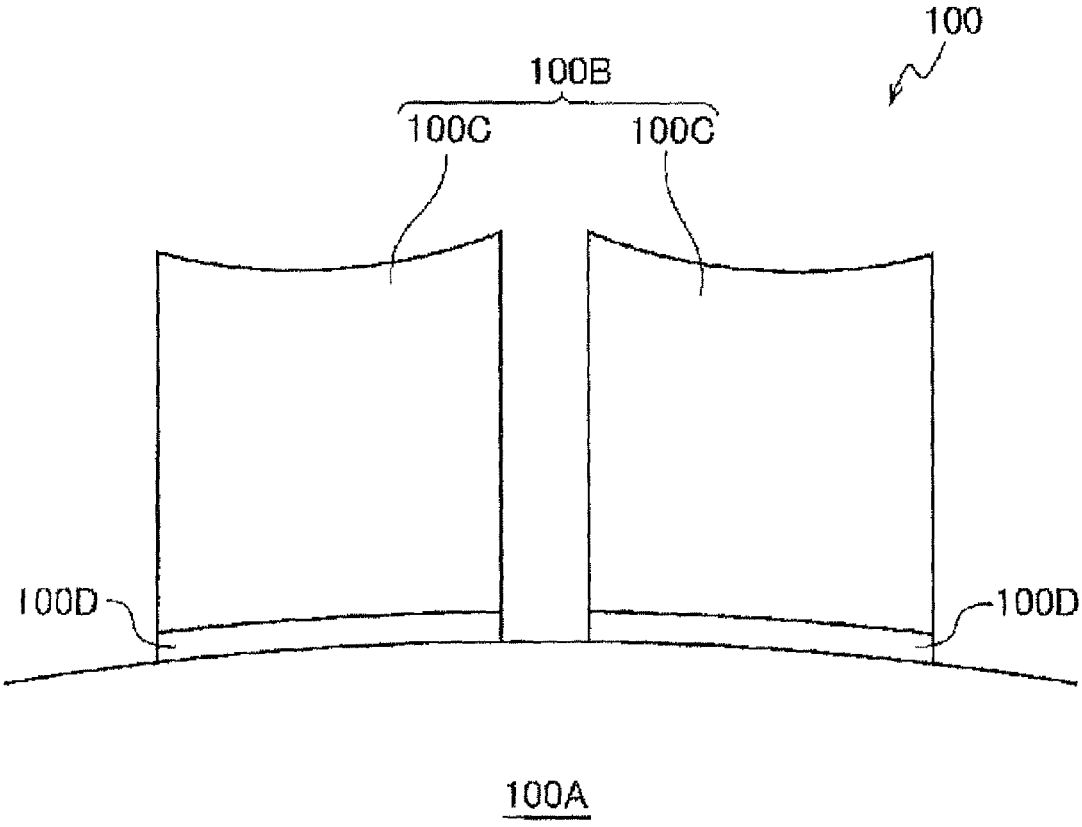
FIG. 4 is an enlarged cross-sectional view showing a foamed elastic layer in the cleaning member for an image forming apparatus related to the present exemplary embodiment.

FIG. 1 is a schematic configuration view showing a cleaning member for an image forming apparatus related to the present exemplary embodiment. FIG. 2 is a schematic partial enlarged view of the cleaning member for an image forming apparatus related to the present exemplary embodiment. FIGS. 3A to 3C are schematic perspective views showing one longitudinal end portion of the cleaning member for the image forming apparatus related to the present exemplary embodiment. FIG. 4 is an enlarged cross-sectional view showing a foamed elastic layer in the cleaning member for an image forming apparatus related to the present exemplary embodiment.

A cleaning member 100 (hereinafter simply referred to as a cleaning member) for an image forming apparatus related to the present exemplary embodiment as shown in FIGS. 1 to 4, is a roll-shaped member including a core member 100A, a foamed elastic layer 1008, and an adhesive layer 100D for bonding together the core member 100A and the foamed elastic layer 100B.

The foamed elastic layer 100B is formed such that two or more strip-shaped foamed elastic members 100C (hereinafter referred to as strips 100C) are spirally wound around the outer peripheral surface of the core member 100A from one end of the core member 100A to the other end thereof. Specifically, for example, the foamed elastic layer 100B is arranged such that, with the core member 100A as a spiral shaft and two or more strips 100C as a set, the set of strips 1000 being spirally wound around the outer peripheral surface of the spiral shaft at a distance between the strips from one end of the core member 100A to the other end thereof.

The two or more strips 100C (strip-shaped foamed elastic members) are connected to each other at one or both of longitudinal ends thereof.

In addition, FIGS. 1 to 4 show an aspect in which, the foamed elastic layer 100B is formed such that two or more strips 100C (strip-shaped foamed elastic members) that are connected to each other at both of the longitudinal ends are spirally wound around the outer peripheral surface of the core member 100A from one end of the core member 100A to the other end thereof.

Here, in a case where the strips 1000 are wound around the core member 100A and the foamed elastic layer 100B is spirally arranged at the outer peripheral surface of the core member 100A, it is required to give a predetermined tension in the longitudinal direction (winding direction) when the strips 100C are wound around the outer peripheral surface of the core member 100A. It is believed that the foamed elastic layer 100B in a wound state around the core member 100A is arranged in a state (for example, a state where the foamed elastic layer becomes small with respect to the thickness of the central portions of the strips 100C in the width direction before winding) where the foamed elastic layer is elastically deformed according to the tension and the curvature of the core member 100A.

On the other hand, it is believed that, since the foamed elastic layer 100E in a wound state around the core member 100A is fixed along the outer peripheral surface of the core member 100A in an elastically deformed state, a repulsive elastic force accompanying the elastic deformation amount of the foamed elastic layer 1003 is generated. It is believed that, since this repulsive elastic force works in a direction in which the foamed elastic layer 100B contracts, that is, works in a direction along in the spiral direction (the winding direction of the strips 100C) of the foamed elastic layer 100B, the repulsive elastic force is applied in a direction in which the longitudinal ends of the foamed elastic layer 100B are peeled on the outer peripheral surface of the core member 100A.

Peeling becomes apt to occur from a corner portion 100$C_1$ that faces toward the axial central portion of the core member 100A or a corner portion 100$C_1$ that protrudes outward in the spiral direction of the foamed elastic layer 100B (hereinafter, the corner portion 100$C_1$ that faces toward the axial central portion of the core member 100A in the longitudinal ends of the foamed elastic layer 1003 or the strips 100C or the corner portion 100$C_1$ that protrudes outward in the spiral direction of the foamed elastic layer 100B may be simply referred to as a "corner portion 100$C_1$", a "corner portion 100$C_1$ of the foamed elastic layer 1003 or the strips 100C"), among corner portions of the longitudinal ends of the foamed elastic layer 100B.

That is, the corner portion 100$C_1$ tends to become a starting point of peeling. It is believed that this is because, in the longitudinal ends of the foamed elastic layer 100B or the strips 100C, a repulsive elastic force applied to the other corner portion opposed to the corner portion 100$C_1$ is decentralized in the spiral direction and in a direction toward the corner portion 100$C_1$, whereas a repulsive elastic force applied to the corner portion 100$C_1$ becomes a resultant force in the spiral direction and in the direction toward the corner portion 100$C_1$.

In addition, it is believed that, since this repulsive elastic force works strongly as the thickness and elastic modulus of the foamed elastic layer 100B and the curvature radius of the core member are larger, the foamed elastic layer 100B is apt to be peeled.

Moreover, in a case where the cleaning member is rotated in contact with a member to be cleaned, an end (that is, an end where the cleaning member rushes into the member to be cleaned when the cleaning member is rotated in contact with the member to be cleaned) on one side that becomes an opposite direction (direction in which the elastic layer is apt to be peeled) among both longitudinal ends of the foamed elastic layer 100B tends to be peeled particularly.

Meanwhile, in a case where the two or more strips 100C are spirally wound around the outer peripheral surface of the core member 100C to constitute the foamed elastic layer 100B, the longitudinal ends of the foamed elastic layer 100B are configured such that the respective longitudinal ends of the two or more strips 1000 are spaced apart from each other.

In this state, since the respective strips 1000 that become the foamed elastic layer 100B are spaced apart from each other in one or both of the longitudinal ends thereof (or are not fixed mutually even if the strips come into contact with each other), locations that become the starting points of peeling of the foamed elastic layer 100E become the corner portions 100$C_1$ of the strips 100C respectively, and plural locations are present.

In contrast, in the cleaning member 100 related to the present exemplary embodiment, the two or more strips 100C that become the foamed elastic layer 100B are connected to each other at one or both of the longitudinal ends.

Thereby, as the overall foamed elastic layer 100B, the two or more strips 100C are connected to each other at one or both of the longitudinal ends thereof. Therefore, the foamed elastic body is constituted by one strip 100C at the connected ends). As a result, the corner portion 100$C_1$ that becomes the starting point of the peeling becomes one apparently (refer to FIGS. 3A to 3C).

For this reason, it is believed that peeling of the foamed elastic layer 100E from the core member 100A is suppressed by the cleaning member 100 related to the present exemplary embodiment.

In addition, the corner portion 100$C_1$ (or corner portion 100$C_1$ that faces toward the axial central portion of the core member 100A at an end where the two or more strips 100C that become the foamed elastic layer 100B are connected together) that faces toward the axial central portion of the core member 100A in the longitudinal ends of the foamed elastic layer 100B or the strips 100C is a corner portion opposed to the foamed elastic layer 100C (strips 100C) that is located at the axial central portion of the core member 100A and spirally wound among the corner portions that constitute the end (refer to FIG. 3A).

Additionally, the corner portion 100$C_1$ (or corner portion 100$C_1$ that protrudes outward in the spiral direction of the foamed elastic layer 1003 at an end where the two or more strips 100C that become the foamed elastic layer 100B are connected together) that protrudes outward in the spiral direction of the foamed elastic layer 100B in the longitudinal ends of the foamed elastic layer 100B or the strips 100C is a corner that is located so as to protrude most outward in the winding direction of the strips 100C from the end among the corner portions that constitute the end (refer to FIGS. 3B and 3C).

That is, both the corner portion 100$C_1$ that faces toward the axial central portion of the core member 100A and the corner portion 100$C_1$ that protrudes outward in the spiral direction of the foamed elastic layer 1003 are a corner portion located at the rightmost when the longitudinal ends of the formed foamed elastic layer 100E are seen in the winding direction of the strips 100C from the axial outside of the core member 100A in a case where the strips 100C are spirally wound clockwise around the core member 100A, and a corner portion located at the leftmost when the longitudinal ends of the formed foamed elastic layer 100B are seen in the winding direction of the strips 100C from the axial outside of the core member 100A in a case where the strips 100C are spirally wound counterclockwise around the core member 100A.

Additionally, in the cleaning member 100 related to the present exemplary embodiment, the corner portion 100$C_1$ that becomes the starting point of peeling of the foamed elastic layer 100B becomes one. Therefore, there is an advantage that the peeling-preventing processing of the foamed elastic member is also performed only in one location.

In addition, as the proportion by which a location where compression processing is performed as this peeling-preventing processing comes into contact with the member to be cleaned decreases, a poor cleaning region is apt to be produced. Therefore, this peeling-preventing processing is performed only in one location at the end of the foamed elastic layer 100B (strips 100C). Thus, there is also an advantage that the axial length of the cleaning member 100 is no longer increased more than needed in order to secure a cleaning region.

Examples of this peeling-preventing processing include the processing of setting the area of a region that comes into contact with the outer peripheral surface of the core member 100A via the adhesive layer 100D to be equal to or more than 40% in an area ratio per unit area (hereinafter referred to as a contact area ratio) in the surface (hereinafter, the surface of the foamed elastic layer 100B (strips 100C) opposed to the outer peripheral surface of the core member 100A is referred to as an "undersurface") opposed to the outer peripheral surface of the core member 100A in the corner portion 100$C_1$ that faces toward the axial central portion of the core member 100A or the corner portion 100$C_1$ that protrudes outward in the spiral direction of the foamed elastic layer 1003, at an end where the two or more strips 100C (foamed elastic members) that become the foamed elastic layer 1003 are connected to each other.

Here, since the foamed elastic layer 1003 (strips 100C) has bubbles, a number of recesses resulting from the bubbles (foamed skeletal structure) are present in the undersurface of the foamed elastic layer 100B that comes into contact with the outer peripheral surface of the core member 100A via the adhesive layer 100D. Due to these recesses, compared to a non-foamed elastic layer, it is believed that a region that actually comes into contact with the outer peripheral surface of the core member 100A via the adhesive layer 100D tends to become small in the undersurface of the foamed elastic layer 100B in the bonding between the undersurface of the foamed elastic layer 1003 and the outer peripheral surface of the core member 100A by the adhesive layer 100D, and the adhesive force is apt to be insufficient.

For this reason, for example, the processing of setting the contact area ratio of the undersurface in the corner portion 1000 that faces toward the axial central portion of the core member 100A or the corner portion 100$C_1$ that protrudes outward in the spiral direction of the foamed elastic layer 1003 to be equal to or more than 40%, at an end where the two or more strips 100C (foamed elastic members) that become the foamed elastic layer 1003 are connected to each other, may be performed.

Thereby, it is believed that the total area of a region (portion) that comes into direct contact with the core member 100A via the adhesive layer 100D in the undersurface in the corner portion 100$C_1$ that faces toward the axial central portion of the core member 100A or the corner portion 100$C_1$ that protrudes outward in the spiral direction of the foamed elastic layer 100B is increased at an end where the two or more strips 100C (foamed elastic members) that become the foamed elastic layer 100B that becomes the starting point of peeling are connected to each other, and more adhesive force is obtained, and peeling (that is, peeling of the foamed elastic layer 100B from the corner portion 100$C_1$) of the foamed elastic layer 100B from the core member 100A is suppressed.

Additionally, due to this peeling-preventing processing, the viscosity of the adhesive layer 100D that bonds together the foamed elastic layer 1003 and the core member 100A becomes weak in a case where the cleaning member 101 is stored for a certain period (for example, 24 hours or more) in a high-temperature environment (for example, under the temperature condition of 50° C.), and peeling (that is, peeling of the foamed elastic layer 100B from the corner portion 100$C_1$) of the foamed elastic layer 100B from the core member 100A is apt to occur. However, in the cleaning member 101 related to the present exemplary embodiment, peeling (that is, peeling of the foamed elastic layer 1003 from the corner portion 100$C_1$) of the foamed elastic layer 100B from the core member 100A is suppressed even in a case where the cleaning member is stored for a certain period under such a high-temperature environment.

In a charging device, a process cartridge, and an image forming apparatus including the cleaning member 100 related to the present exemplary embodiment, peeling (that is, peeling of the foamed elastic layer 1003 from the corner portion 100$C_1$) of the foamed elastic layer 100B from the core member 100A is suppressed. Thus, charging performance degradation caused by poor cleaning of a charging member, and an image defect (for example, density unevenness) resulting therefrom are suppressed.

Respective members will be described below.

First, the core member will be described.

The material to be used for the core member 100A includes a metal (for example, free cutting steel, stainless steel or the like) or a resin (for example, polyacetal resin (POM) or the like). In addition, it is preferable that the material, the surface-processing method, or the like be selected if needed.

Particularly, it is preferable to perform plating in a case where the core member 100A is made of a metal. Additionally, in the case of a material that does not have conductivity, such as resin, the core member may be subjected to conducting processing through general processing, such as plating, or may be used as it is.

Next, the adhesive layer will be described.

The adhesive layer is not particularly limited if the core member 100A and the foamed elastic layer 100B may be bonded together. For example, however, the adhesive layer is constituted by a double-sided tape and other adhesives.

Next, the foamed elastic layer will be described.

The foamed elastic layer 100B is arranged such that the two or more strips 100C (strip-shaped foamed elastic members) are spirally wound around the core member 100A.

Then, the two or more strips 100C are connected to each other at one or both of longitudinal ends thereof. The two or more strips 100C may be connected together with a target width at one or both of the longitudinal ends of the foamed elastic layer 1003, and the shape of the ends is not limited (for example, refer to FIGS. 3A to 3C, FIGS. 6A to 6C, and FIGS. 7A to 7C).

Figure 6A:
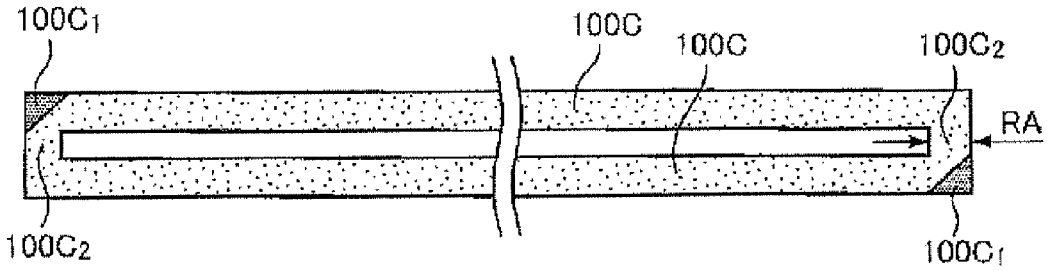
FIGS. 6A to 6C are schematic plan views showing a strip-shaped foamed elastic member that becomes the foamed elastic layer in the cleaning member for an image forming apparatus related to the present exemplary embodiment.
Figure 6B:
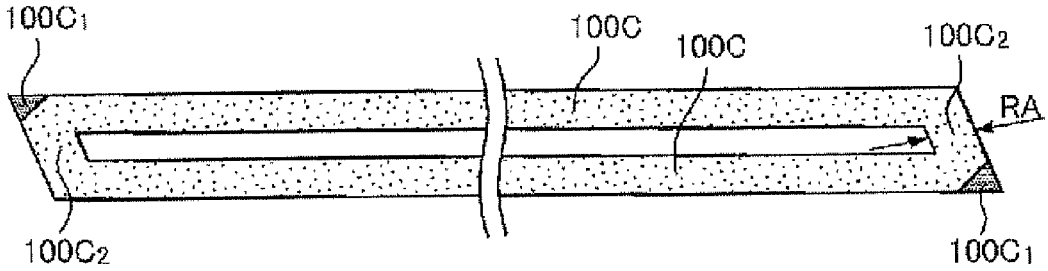
Figure 6C:
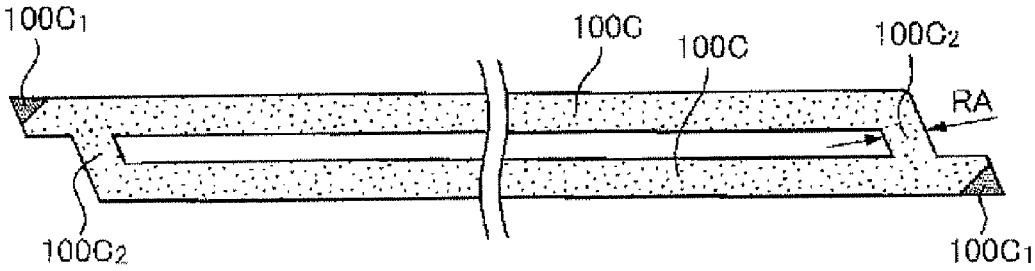

The width RA (the longitudinal length of the strips 100C in the case of the shape of FIG. 6A) of a connecting portion 100$C_2$ where the two or more strips 100C (strip-shaped foamed elastic members) that becomes the foamed elastic layer 100B are connected to each other may be equal to or more than twice the void diameter (so-called cell diameter) of the strips 100C (refer to FIGS. 6A to 6C). Additionally, the upper limit of the width RA may be equal to or less than the width of the strips 100C from the viewpoint of securing the cleaning region of the cleaning member 100 in the longitudinal direction.

By setting the width RA of the connecting portion 100$C_2$ to be equal to or more than twice the void diameter (cell diameter) of the strips 100C, tearing-off of the connecting portion 100$C_2$ resulting from shortage of strength caused by the voids (cells) of the strips 100C (that is, the foamed elastic layer 100B) is suppressed. As a result, peeling of the foamed elastic layer 100B (strips 1000) from the core member 100A is easily suppressed.

In addition, the width RA of the connecting portion 100$C_2$ means a length along the opposed direction of two sides (two sides that intersect the longitudinal direction of the strips 100C) that constitute the connecting portion 100$C_2$.

Here, the void diameter (cell diameter) of the strips 100C is, for example, from 0.1 mm to 1.0 mm, preferably from 0.2 mm to 0.9 mm, and more preferably from 0.4 mm to 0.8 mm.

In addition, the void diameter (cell diameter) means an "average void diameter (average cell diameter)", obtained by measuring the number of cells per 25 mm in length according to JISK 6400-1 (2004) Annex 1 and performing calculation from 25 mm/Number of cells.

The foamed elastic layer 100B may be arranged so as to be spirally wound in a state where the longitudinal sides of adhesive surfaces (undersurfaces of the strips 100C that face the outer peripheral surface of the core member 100A) of the strips 100C are brought into contact with each other, or may be arranged so as to be spirally wound in a non-contact state.

In addition, FIGS. 1 to 4 show an aspect in which the foamed elastic layer 100B is arranged so as to be spirally wound in a state where the longitudinal sides of adhesive surfaces (undersurfaces of the strips 100C that face the outer peripheral surface of the core member 100A) of the strips 1000 are not brought into contact with each other.

The contact area ratio of the undersurface in the corner portion 100$C_1$ that faces toward the axial central portion of the core member 100A or the corner portion 100$C_1$ that protrudes outward in the spiral direction of the foamed elastic layer 100B, at an end where the two or more strips 1000 (foamed elastic members) that become the foamed elastic layer 100B are connected to each other, may be set to be equal to or more than 40% (preferably equal to or more than 60%).

In addition, as this contact area ratio is made higher, an adhesive force that is equal to or more than a repulsive elastic force generated at one or both of the longitudinal ends of the foamed elastic layer 100B is more easily obtained, and peeling (that is, peeling of the foamed elastic layer 100B from the corner portion 100$C_1$) of the foamed elastic layer 100E from the core member 100A is more easily suppressed.

Here, the "contact area ratio" means the ratio of the area of a region that comes into contact with (that is, comes into direct contact with the adhesive layer 100D) the outer peripheral surface of the core member 100A via the adhesive layer 100D in the undersurfaces of the corner portion 100$C_1$ of the foamed elastic layer 100B, with respect to the total area (projected area when being projected in a layer thickness direction) of the undersurface of the corner portion 100$C_1$ of the foamed elastic layer 1003. In other words, since the undersurface of the corner portion 100$C_1$ of the foamed elastic layer 1003 has a concavo-convex shape, and top portions (top faces) of the convex portions become portions that come into contact with (that is, come into direct contact with the adhesive layer 100D) the outer peripheral surface of the core member 100A via the adhesive layer 100D, "the contact area ratio" means the proportion of the area of the top portions (top faces) of the convex portions that come into contact with the outer peripheral surface of the core member 100A via the adhesive layer 100D with respect to the total area of the undersurface of the corner portion 100$C_1$ of the foamed elastic layer 1003.

The "contact area ratio" is defined as a value calculated as follows.

The corner portion 100$C_1$ of the foamed elastic layer 100B that becomes an object to be measured is partially peeled off from the cleaning member 101 by a cutter to obtain an elastic layer sample.

After the elastic layer sample is placed on a horizontal ink platform on which a liquid ink film (100 μm in thickness) is formed such that the surface (layer that is the undersurface of the foamed elastic layer 100B) that becomes an object to be measured comes into contact with ink, a pressing is made from on the elastic layer sample with a load of 40 g/$cm^2$, and a portion of the surface of the object to be measured (a structure skeleton portion of a foamed body) of the elastic layer sample is colored with ink.

Then, an image of the surface of the object to be measured of the elastic layer sample is captured using a microscope (Type: VHX-200 made by KEYENCE Corp.), binarization is performed by a colored portion and a non-colored portion using an image analysis software (WinROOF made by MITANI Corporation) in a square range of 1 mm×1 mm of the captured image, the ratio of a contact portion occupied in the surface of the object to be measured is measured, and this is taken as the contact area ratio.

In addition, the condition of the binarization in the image-analysis software is that image analysis processing based on a threshold obtained by the "discrimination analysis method" is performed on a captured image subjected to processing of making an image black and white in 255 grayscales, and a portion more than the threshold is defined as the colored portion and a portion less than the threshold is defined as a non-colored portion.

In order to set the "contact area ratio" to the above range, for example, there is provided a method of performing compression processing (for example, heat compression processing) on the corner portion 100$C_1$ at an end where the two or more strips 100C (strip-shaped foamed elastic members) that becomes the corner portion 100$C_1$ of the foamed elastic layer 100B are connected to each other, in the thickness direction of the foamed elastic layer 100B.

Specifically, for example, the compression processing is performed by preparing two or more strips 100C whose ends before wound around the core member 100A (for example, a strip-shaped foamed elastic member with a foaming rate of from 50 pieces/25 mm to 70 pieces/25 mm) are connected to each other, and by giving heat and pressure to the corner portion 100$C_1$ at the ends that are connected to each other so that the compressibility (Thickness after Compression/Thickness before Compression×100) in the thickness direction becomes from 10% to 70%.

This compression processing may be performed on a foamed elastic member before being clipped in the shape of a strip.

Thereby, a foamed structure skeleton that constitutes the undersurface of the corner portion 100$C_1$ at an end where the two or more strips 100C (foamed elastic layer 100B) are connected to each other becomes apt to disappear (does not necessarily disappear completely), and the contact area ratio becomes apt to increase.

Additionally, in order to set the "contact area ratio" to the above range, for example, the undersurface of the corner portion 100$C_1$ at an end where the two or more strips 1000 (strip-shaped foamed elastic members) that become the foamed elastic layer 100B are connected to each other is constituted by a non-foamed layer.

Specifically, for example, the corner portion 100$C_1$ at an end where the two or more strips 100C (strip-shaped foamed elastic members) are connected to each other is constituted by a laminate of a non-foamed layer and a foamed layer.

This configuration is realized, for example, by clipping the strips 1000 (foamed elastic layer 100B) such that the skin layer (a non-foamed layer that constitutes a surface that comes into contact with a mold) of the surface of a produced foamed elastic body (a lump of a foamed body after molding and before clipping: for example, a foamed urethane foam or the like) constitutes the undersurface of the corner portion 100$C_1$ of the strips 100C (foamed elastic layer 100B).

Thereby, the undersurface of the corner portion 100$C_1$ of the strips 100C (foamed elastic layer 100B) is constituted by a non-foamed layer, and the contact area ratio becomes apt to increase.

The foamed elastic layer 100B (strips 100C) is made of a material (so-called foamed body) having bubbles.

Examples of the material of the foamed elastic layer 100B (strips 100C) include one of foamable resins such as polyurethane, polyethylene, polyamide, or polypropylene or rubber materials such as silicone rubber, fluororubber urethane rubber, EPDM, NBR, CR, chlorinated polyisoprene, isoprene, acrylonitrile-butadiene rubber, styrene-butadiene rubber, hydrogenated polybutadiene, and butyl rubber, or materials obtained by blending one or two or more thereof.

In addition, agents, such as a foaming agent, a foam stabilizer, a catalyst, a curing agent, a plasticizer, or a vulcanization accelerator, may be added to these materials if needed.

It is preferable that the foamed elastic layer 100B (strips 100C) be particularly foamed polyurethane that does not damage the surface of a member to be cleaned by rubbing and that has strong pulling from a viewpoint from keeping tearing-off and damage from occurring for a long period of time.

Examples of the polyurethane include reactants of polyols (for example, polyester polyol, polyether polyester, acrylic polyol, and the like), isocyanates (for example, 2,4-tolylene diisocyanate, 2,6-tolylene diisocyanate, 4,4-diphenylmethane diisocyanate, tolidine diisocyanate, 1,6-hexamethylene diisocyanate, and the like), and may contain chain extenders (1,4-butanediol and trimethylolpropane).

It is general that foaming of the polyurethane is performed using, for example, foaming agents, such as water and azo compounds (for example, azodicarbonamide, azobisisobutyronitrile, and the like). Agents, such as a foaming agent, a foam stabilizer, and a catalyst, may be added to the foamed polyurethane if needed.

Among the above foamed polyurethane, ether-based foamed polyurethane is preferable. This is because the ester-based foamed polyurethane tends to deteriorate due to heat and humidity. Although a foam stabilizer of silicone oil is mainly used for the ether-based polyurethane, an image defect may occur as silicone oil shifts to a member to be cleaned (for example, a charging roll or the like) in storage (particularly long term storage under high temperature and high humidity). For the reason, an image defect resulting from the foamed elastic layer 100E is suppressed by using foam stabilizers other than silicone oil.

Here, specific examples of foam stabilizers other than silicone oil include organic surfactants (for example, anionic surfactants, such as dodecylbenzenesulfonic acid and sodium lauryl sulfate) that do not contain Si. Additionally, a manufacturing process that does not use a silicone-based foam stabilizer described in JP-A-2005-301000 can also be applied.

In addition, whether or not foam stabilizers other than silicone oil have been used for the ester-based foamed polyurethane is determined by whether or not "Si" is contained by componential analysis.

For example, the thickness (thickness at the central portion in the width direction) of the foamed elastic layer 100B (strips 100C) is, for example, from 1.0 mm to 4.0 mm, preferably from 1.5 mm to 3.0 mm, and more preferably from 1.7 mm to 2.5 mm.

In addition, the thickness of the foamed elastic layer 100B is measured as follows, for example.

The profile of foamed elastic layer thickness (foamed elastic layer thickness) is measured by performing scanning in the longitudinal direction (axial direction) of a cleaning member at a traverse speed of 1 mm/s, in a state where the circumferential direction of the cleaning member is fixed, using a laser measurement machine (Laser Scanning Micrometer by MITUTOYO Corp., TYPE: LSM6200). Thereafter, the circumferential position is shifted, and the same measurement is performed (circumferential positions are intervals of 120°, three locations). The thickness of the foamed elastic layer 100B is calculated on the basis of this profile.

The (overall) foamed elastic layer 100B is spirally arranged. Specifically, for example, the spiral angle θ may be from 10° to 65° (preferably from 20° to 50°), and the spiral width R1 may be from 3 mm to 25 mm (preferably from 3 mm to 10 mm). Additionally, the spiral pitch R2 may be, for example, from 3 mm to 25 mm (preferably from 15 mm to 22 mm).

In addition, the spiral width of each of the two or more strips 100C that become the foamed elastic layer 100B may be from 1.5 mm to 12.5 mm (preferably from 1.5 mm to 5.0 mm).

As for the (overall) foamed elastic layer 100B, the coverage (Spiral width R1 of foamed elastic layer 100B/Spiral width R1 of foamed elastic layer 100B+Spiral pitch R2 of foamed elastic layer 1003: (R1+R2)) may be from 20% to 70%, and preferably from 25% to 55%.

If the coverage is greater than the above range, the time for which the foamed elastic layer 100B comes into contact with a member to be cleaned becomes long. Therefore, the tendency for extraneous matter that adheres to the surface of a cleaning member to soil the member to be cleaned again becomes high. On the other hand, if the coverage is smaller than the above range, stabilization of the thickness (thickness) of the foamed elastic layer 1003 becomes difficult, and the cleaning capability tends to decline.

In addition, the spiral angle θ means an angle (acute angle) at which the longitudinal direction P (the spiral direction) of the foamed elastic layer 100B and the axial direction Q (core member axial direction) of the cleaning member 100 intersect each other.

The spiral widths R1 and R11 mean a length along the axial direction Q (core member axial direction) of the cleaning member 100 of the foamed elastic layer 1003.

The spiral pitch R2 means a length between adjacent foamed elastic layers 100B along the axial direction Q (core member axial direction) of the cleaning member 100 of the foamed elastic layer 100B.

Additionally, the foamed elastic layer 100B means a layer made of a material restored to its original shape, even if the layer is deformed by application of an external force of 100 Pa.

Next, a method for manufacturing the cleaning member 100 related to the present exemplary embodiment will be described.

Figure 5A:
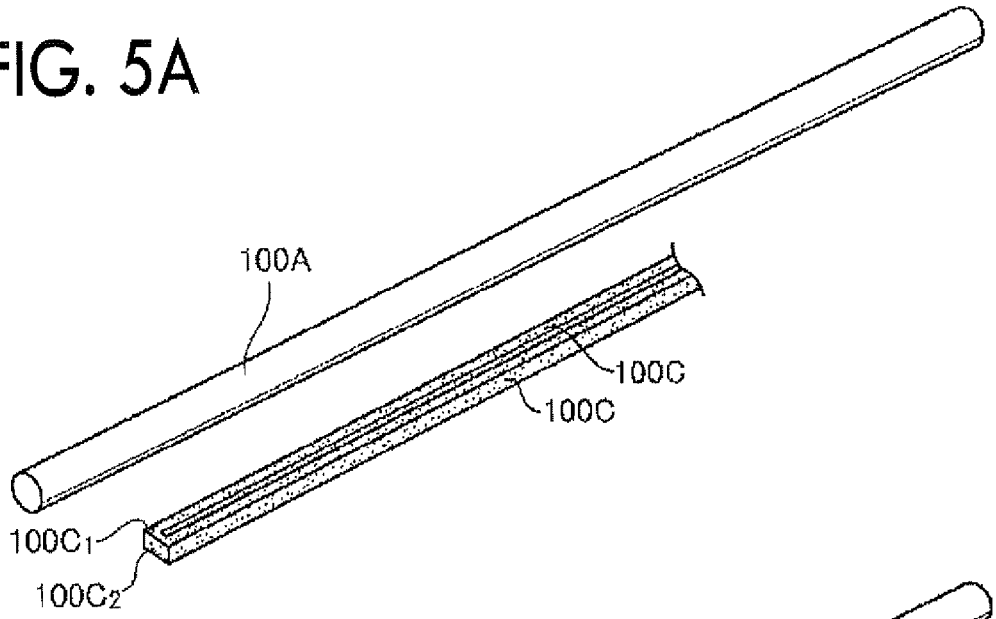
FIGS. 5A to 5C are process views showing an example of a method for manufacturing the cleaning member for an image forming apparatus related to the present exemplary embodiment.
Figure 5B:
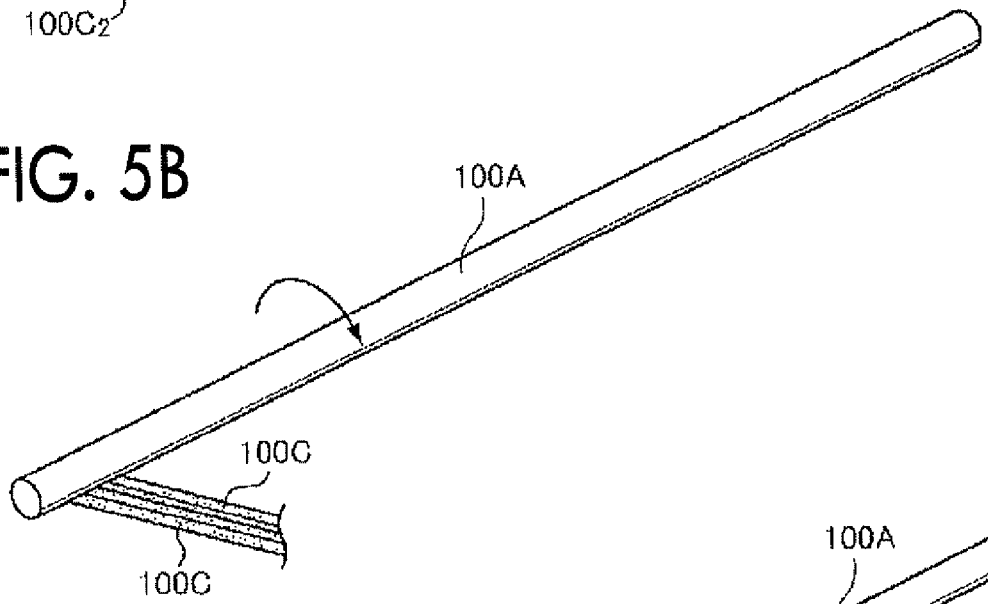
Figure 5C:
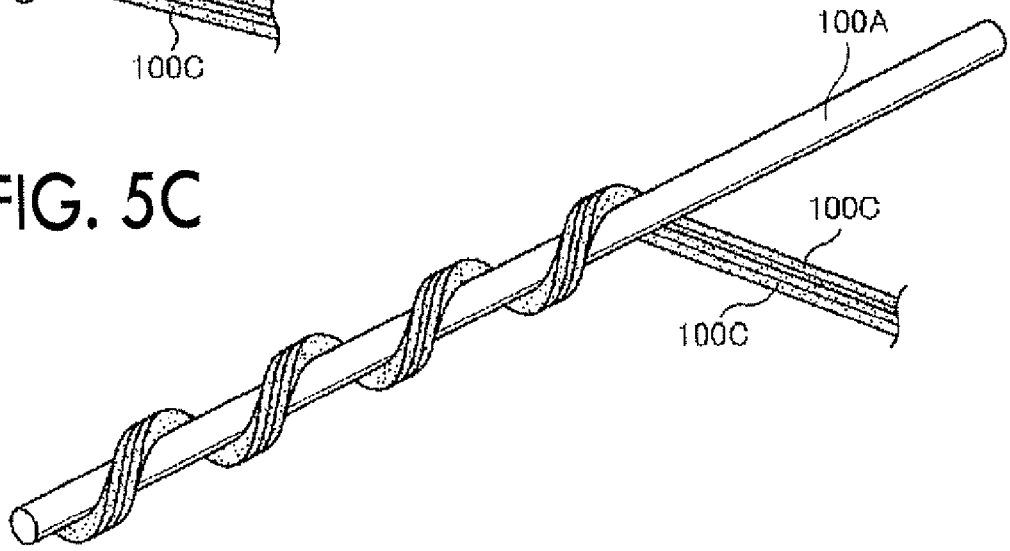

FIGS. 5A to 5C are process views showing an example of the method for manufacturing the cleaning member 100 related to the present exemplary embodiment. In addition, the process view shown in FIG. 5 shows an aspect in which two strips 100C are used as an example.

First, as shown in FIG. 5A, a sheet-shaped foamed elastic member (foamed polyurethane sheet or the like) that is subjected to slicing so as to have a target thickness is prepared, a double-sided tape (not shown) is stuck on one side of the sheet-shaped foamed elastic member. Then, the member is punched by a punch die so as to have target width and length. Two or more strips 100C (strip-shaped foamed elastic members with double-sided tape) connected together at one or both of longitudinal ends are obtained. On the other hand, the core member 100A is also prepared.

Here, the two or more strips 100C to be prepared by punching have, for example, a shape provided with slits such that the two or more strips 100C are spaced apart and separated from each other except for one or both of the longitudinal ends thereof (refer to FIGS. 6A to 6C and FIGS. 7A to 7C).

The two or more strips 1000 to be prepared by punching are not limited to this in terms of their shape, and may have, for example, a shape provided with slits such that the strips are separated from each other while being brought into contact with each other except for one or both of the longitudinal ends thereof.

Figure 7A:
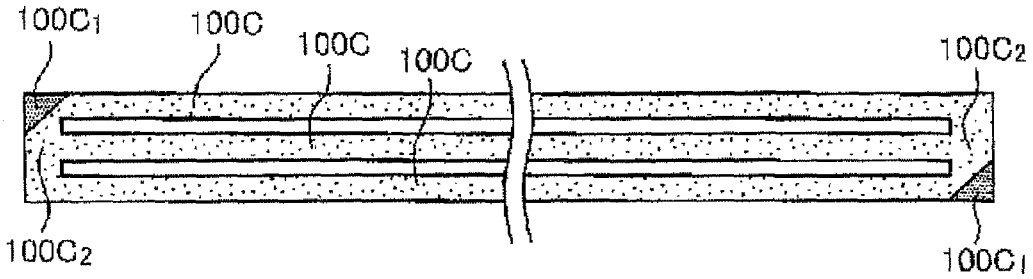
FIGS. 7A to 7C are schematic plan views showing another strip-shaped foamed elastic member that becomes the foamed elastic layer in the cleaning member for an image forming apparatus related to the present exemplary embodiment.
Figure 7B:
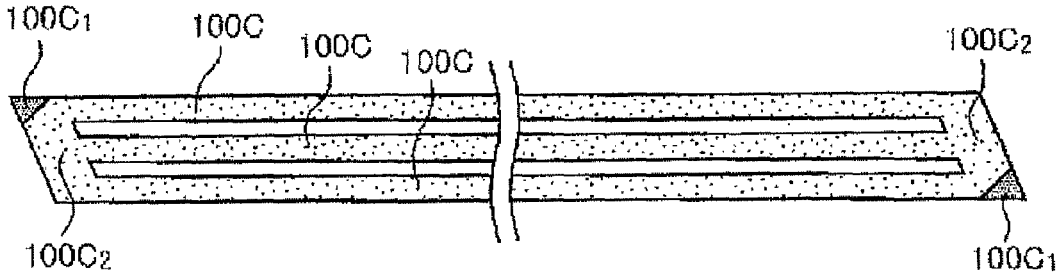
Figure 7C:
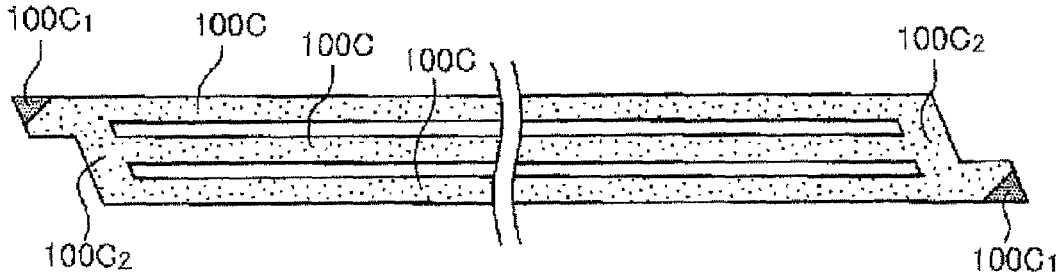

In addition, FIGS. 6A to 6C are plan views when both the longitudinal ends of two strips 100C are connected together, and FIGS. 7A to 7C are plan views when the longitudinal ends of three strips 100C are connected together.

Specifically, FIGS. 6A and 7A show examples in which the two or three strips 100C have a shape such that mutually connected ends have sides along a direction orthogonal to the longitudinal direction of the strips 100C. The state of the longitudinal ends of the foamed elastic layers 100C formed by winding the two strips 100C with the shape shown in FIG. 6A around the core member 100A is equivalent to the state shown in FIG. 3A.

Additionally, FIGS. 6B and 7B show examples in which an end where the two or three strips 100C are connected to each other has a side that inclines in the longitudinal direction of the strips 100C, and a portion equivalent to the corner portion 100$C_1$ has an acute shape that protrudes in the longitudinal direction of the strips 100C. The state of the longitudinal ends of the foamed elastic layers 100C formed by winding the two strips 100C with the shape shown in FIG. 6B around the core member 100A is equivalent to the state shown in FIG. 3B.

Additionally, FIGS. 6C and 7C show examples in which an end where the two or three strips 100C are connected to each other is provided with a cutout, and a portion equivalent to the corner portion 100$C_1$ has a shape that protrudes in the longitudinal direction of the strips 100C. The state of the longitudinal ends of the foamed elastic layers 100C formed by winding the two strips 100C with the shape shown in FIG. 6C around the core member 100A is equivalent to the state shown in FIG. 3C.

Additionally, in order to set "the contact area ratio" of the undersurface of the corner portion 100$C_1$ at an end where the two or more strips 1000 are connected to each other to the above range, the compression processing may be performed on the relevant portion of a sheet-like foamed elastic member, and the compression processing may be performed on obtained strips 100C. In addition, the compression processing may be performed before a double-sided tape as the adhesive layer 100C is stuck, or may be performed after the sticking.

On the other hand, in order to set the "contact area ratio" of the undersurface of the corner portion 100$C_1$ at an end where the two or more strips 100C are connected to each other to the above range, when slicing is performed to obtain a sheet-like foamed elastic member, the skin layer (non-foamed layer that constitutes a surface that comes into contact with a mold) of the surface of the foamed elastic body before the slicing may be sliced to obtain a sheet-like foamed elastic member so as to constitute the undersurface of the corner portion 1000 at an end where the two or more strips 100C (foamed elastic layer 100B) are connected to each other.

Next, as shown in FIG. 5B, the two or more strips 100C are arranged with the surface with the double-sided tape being turned up, one end of a separate paper of the double-sided tape is peeled in this state, and one end portion of the core member 100A is placed on the double-sided tape from which the separate paper is separated.

Next, as shown in FIG. 5C, while the separate paper of the double-sided tape is peeled, the core member 100A is rotated at a target speed, the two or more strips 100C are spirally wound around the outer peripheral surface of the core member 100A, and the cleaning member 100 having the elastic layer 10013 spirally arranged on the outer peripheral surface of the core member 100A is obtained.

Here, when the two or more strips 100C that become the foamed elastic layer 100B are wound around the core member 100A, the strips 100C may be aligned so that the longitudinal direction of the respective trips 100C has a target angle (spiral angle) with respect to the axial direction of the core member 100A. Additionally, the external diameter of the core member 100A may be, for example, about from ϕ3 mm to ϕ6 mm.

The tension to be given when the two or more strips 1000 are wound around the core member 100A may be such that a gap is not generated between the core member 100A and the double-sided tape of each strip 100C, and may be such that the tension is not applied excessively. This is because, when the tension is applied excessively, pulling permanent elongation becomes large, and the elastic force of the foamed elastic layer 100B required for cleaning tends to decrease. Specifically, for example, a tension that becomes an elongation of about more than 0% and 5% or less with respect to the length of each original strip 100C may be applied.

On the other hand, when the two or more strips 100C are wound around the core member 100A, each strip 1000 tends to elongate. This elongation tends to be different in the thickness direction of each strip 100C, the outermost portion of each strip tends to elongate most, and the elastic force may decrease. Therefore, the elongation of the outermost portion after each strip 100C is wound around the core member 100A may become about 5% with respect to the outermost portion of each original strip 100C.

This elongation is controlled depending on the curvature radius of each strip 100C wound around the core member 100A and the thickness of the strips 100C, and the curvature radius of each strip 100C wound around the core member 100A is controlled depending on the external diameter of the core member 100A and the winding angle of each strip 1000.

The curvature radius of the two or more strips 1000 wound around the core member 100A may be, for example, from ((External diameter of core member/2)+0.2 mm to ((External diameter of core member/2)+8.5 mm), and preferably, ((External diameter of core member/2)+0.5 mm to ((External diameter of core member/2)+7.0 mm).

The thickness of each strip 1000 may be, for example, about from 1.5 mm to 4 mm, and preferably, from 1.5 mm to 3.0 mm. Additionally, the width of each strip 100C may be adjusted so that the coverage of the foamed elastic layer 100B becomes the above range. Additionally, the length of each strip 1000 is determined depending on, for example, the axial length of a region to be wound around the core member 100A, the winding angle, and a tension when being wound.

Image Forming Apparatus or the Like

An image forming apparatus related to the present exemplary embodiment will be described with reference to the drawings.

Figure 8:
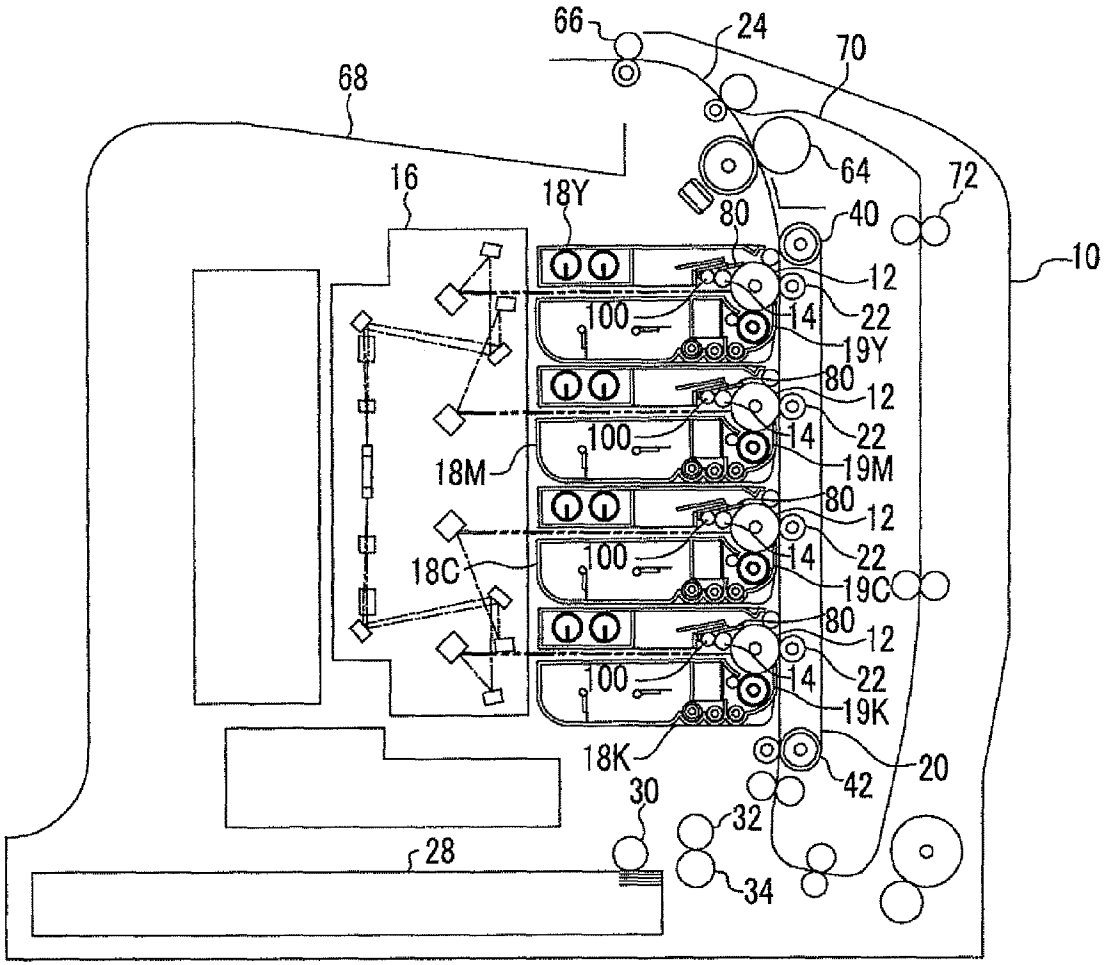
FIG. 8 is a schematic configuration view showing an electrophotographic image forming apparatus related to the present exemplary embodiment.

FIG. 8 is a schematic configuration view showing the image forming apparatus related to the present exemplary embodiment.

Figure 9:
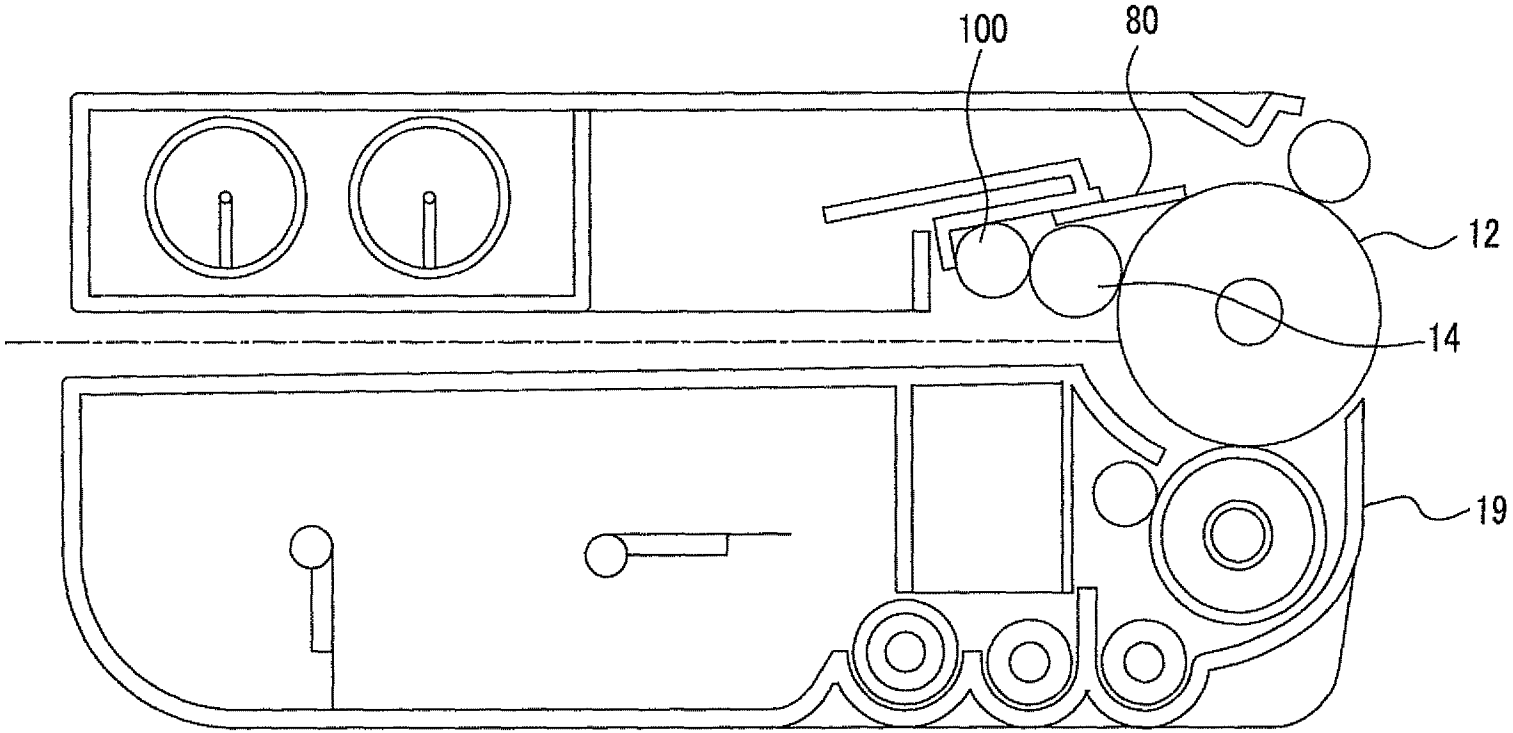
FIG. 9 is a schematic configuration view showing a process cartridge related to the present exemplary embodiment.

The image forming apparatus 10 related to the present exemplary embodiment is, for example, a tandem color image forming apparatus shown in FIG. 8. Inside the image forming apparatus 10 related to the present exemplary embodiment, a photoreceptor (image holding member) 12, a charging member 14, a developing device, or the like are provided as a process cartridge (refer to FIG. 9) for each color of yellow (18Y), magenta (18M), cyan (18C), and black (18K). This process cartridge is configured so as to be attached to and detached from the image forming apparatus 10.

As the photoreceptor 12, for example, a conductive cylindrical member in which the diameter of a photoreceptor layer made of an organic photoreceptor material or the like coated on the surface is 25 mm is used, and is rotationally driven at a target process speed by a motor (not shown).

After the surface of the photoreceptor 12 is charged by the charging member 14 arranged on the surface of the photoreceptor 12, image exposure is performed with a laser beam LB emitted from the exposure device 16 closer to the downstream side in the rotational direction of the photoreceptor 12 than the charging member 14, and an electrostatic latent image according to image information is formed.

The electrostatic latent image formed on the photoreceptor 12 is developed by the developing devices 19Y, 19M, 19C, and 19K for the respective colors of yellow (Y), magenta (M), cyan (C), and black (K), and becomes respective color toner images.

For example, when an image in color is formed, respective processes of charging, exposure, and development are performed on the surfaces of the photoreceptors 12 for the respective colors in correspondence with the respective colors of yellow (Y), magenta (M), cyan (C), and black (K), and toner images corresponding to the respective colors of yellow (Y), magenta (M), cyan (C), and black (K) are formed on the surfaces of the photoreceptors 12 for the respective colors.

The toner images in the respective colors of yellow (Y), magenta (M), cyan (C), and black (K) sequentially formed on the photoreceptors 12 are transferred to a recording paper 24 transported on a sheet transporting belt 20 at the outer peripheries of the photoreceptors 12 in the locations where the photoreceptors 12 come into contact with the transfer devices 22 via the sheet transporting belt 20 supported from the inner peripheral surface thereof while a tension is applied by backup rolls 40 and 42. Moreover, the recording paper 24 to which the toner images on the photoreceptors 12 are transferred is transported to the fixing device 64, and is heated and pressurized by the fixing device 64, whereby the toner images are fixed on the recording paper 24. Thereafter, in the case of one-side printing, the recording paper 24 on which the toner images are fixed is discharged as it is onto a discharging section 68 provided in an upper part of the image forming apparatus 10 by a discharging roll 66.

In addition, the recording paper 24 is taken out from a sheet storage container 28 by a take-out roller 30, and is transported up to the sheet transporting belt 20 by transporting rolls 32 and 34.

On the other hand, in the case of double-side printing, the discharging roll 66 is reversed in a state where a rear end portion of the recording paper 24 is pinched by the discharging roll 66 without discharging the recording paper 24, on which the toner images are fixed on a first side (front surface) by the fixing device 64, to the discharging section 68 as it is via the discharging roll 66. Further, the transport path of the recording paper 24 is switched to a sheet transport path 70 for both sides, and the recording paper 24 is transported onto the sheet transporting belt 20 again in a state where the front and back of the recording paper 24 is reversed by the transporting roll 72 disposed at the sheet transport path 70 for both sides, and then the toner images on the photoreceptors 12 are transferred to a second side (rear surface) of the recording paper 24. Then, the toner images on the second side (rear surface) of the recording paper 24 are fixed by the fixing device 64, and the recording paper 24 (member to be transferred) is discharged onto the discharging section 68.

In addition, the surface of the photoreceptor 12 after the transfer process of a toner image is completed has residual toner, paper debris, or the like thereon removed by a cleaning blade 80 arranged closer to the downstream side in the rotational direction of the photoreceptor 12 than a location where the transfer device 22 comes into contact with the photoreceptor on the surface of the photoreceptor 12 whenever the photoreceptor 12 makes one rotation, and is prepared for the following image formation process.

Figure 10:
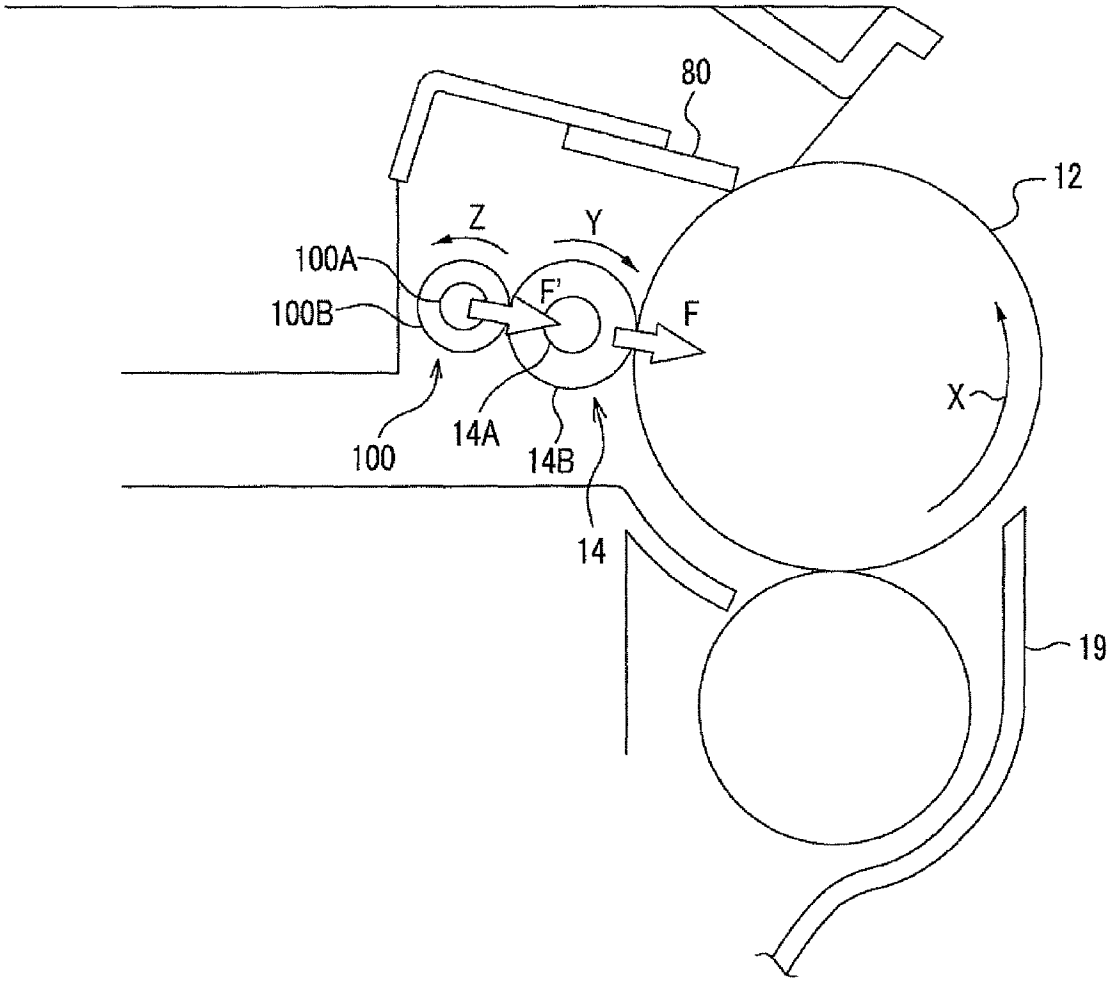
FIG. 10 is an enlarged schematic configuration view of a peripheral portion of a charging member (charging device) in FIGS. 8 and 9.

Here, as shown in FIG. 10, the charging member 14 is, for example, a roll in which the foamed elastic layer 14B is formed around the conductive core member 14A, and the core member 14A is rotatably supported. The cleaning member 100 of the charging member 14 comes into contact with the side of the charging member 14 opposite to the photoreceptor 12 to constitute a charging device (unit). The cleaning member 100 related to the present exemplary embodiment is used as the cleaning member 100.

Although a method of causing the cleaning member 100 to always abut on the charging member 14 and be used to follow the charging member 14 will be described herein, the cleaning member 100 may be caused to always come into contact with the charging member and be used by being driven or may be caused to come into contact with the charging member 14 only during the cleaning thereof, and be used by being driven. Additionally, the cleaning member 100 may be caused to come into contact with the charging member 14 during only the cleaning thereof, and a circumferential speed difference may be given to the charging member 14 by separated driving. However, the method of causing the cleaning member 100 to always come into contact with the charging member 14, and giving the charging member a circumferential speed difference is not preferable from a viewpoint that dirt on the charging member 14 is accumulated into the cleaning member 100, and is easily caused to adhere to the charging roll.

The charging member 14 applies a load F to both ends of the core member 14A, is pushed against the photoreceptor 12, and is elastically deformed along the peripheral surface of the foamed elastic layer 14B to form a nip portion. Moreover the cleaning member 100 applies a load F' to both ends of the core member 100A, and is pushed against the charging member 14, and the foamed elastic layer 100E is elastically deformed along the peripheral surface of the charging member 14 to form a nip portion, thereby suppressing deflection of the charging member 14 to form a nip portion in the axial direction between the charging member 14 and the photoreceptor 12.

The photoreceptor 12 is driven to rotate in the direction of an arrow X by the motor (not shown), and the charging member 14 is driven to rotate in the direction of an arrow Y by the rotation of the photoreceptor 12. Additionally, the cleaning member 100 is driven to rotate in the direction of an arrow Z by the rotation of the charging member 14.

Configuration of Charging Member

Although the charging member will be described below, the charging member is not limited to the following configuration.

Although the configuration of the charging member is not limited, the charging member includes, for example, a configuration having the elastic layer, the core member, or a resin layer instead of the elastic layer. The elastic layer may be constituted by a single layer, or may be constituted by a laminate including plural different layers having multiple functions. Moreover, surface treatment may be performed on the elastic layer.

It is preferable to use free cutting steel, stainless steel, or the like as the material of the core member, and to select a material and a surface treatment method timely according to applications, such as sliding characteristics. Additionally, it is preferable to perform plating. In the case of a material that does not have conductivity, the core member may be subjected to conducting processing through general processing, such as plating, or may be used as it is.

Although a conductive elastic layer is used as the elastic layer, for example, materials that may usually be added to rubber, such as an elastic material such as rubber having elasticity, a conductive material such as carbon black or an ion conductive material that adjusts the resistance of the conductive elastic layer, and if needed, a softener, a plasticizer, a curing agent, a vulcanizing agent, a vulcanization accelerator, an age resistor, a filler such as silica or calcium carbonate, or the like may be added to the conductive elastic layer. The elastic layer is formed by coating a mixture obtained by adding a material which is usually added to rubber on the peripheral surface of the conductive core member. As conductive agents aiming at the adjustment of resistance value, there are used those obtained by dispersing a material that conducts electricity with at least one of the electron and ion of carbon black, anion conductive agent, or the like to be blended with a matrix material being as a charge carrier. Additionally, the elastic material may be a foamed body.

The elastic material that constitutes the conductive elastic layer is formed, for example, by dispersing a conductive agent, in a rubber material. Examples of the rubber material suitably include silicone rubber, ethylene-propylene rubber, epichlorohydrin-ethylene oxide copolymer rubber, epichlorohydrin-ethylene oxide-allylglycidylether copolymer rubber, acrylonitrile-butadiene copolymer rubber, and blend rubbers thereof. These rubber materials may be foamed or non-foamed.

An electron conductive agent or an ion conductive agent is used as the conductive agent. Examples of the electron conductive agent include fine powders, for example, carbon blacks such as ketjen black and acetylene black; pyrolytic carbon, graphite; various conductive metals or alloys such as aluminum, copper, nickel and stainless steel; various conductive metal oxides such as tin oxide, indium oxide, titanium oxide, a solid solution of tin oxide-antimony oxide and a solid solution of tin oxide-indium oxide; and those of which the surface made of the insulating substance is treated to become conductive. Additionally, examples of the ion conductive agent include perchlorates, chlorates, or the like of oniums such as tetraethylammonium and lauryl trimethylammonium; and perchlorates, chlorates, or the like of alkali metals such as lithium and magnesium, and alkaline earth metals.

These conductive agents may be used independently and used in combinations of two or more thereof. Although the additive amount of the conductive agents is not particularly limited, a range from 1 part by weight to 60 parts by weight is preferable with respect to 100 parts by weight of a rubber material in the case of the electron conductive agents. On the other hand, a range from 0.1 part by weight to 5.0 parts by weight is preferable with respect to 100 parts by weight of a rubber material in the case of the ion conductive agents.

A surface layer may be formed on the surface of the charging member. The material of the surface layer is not particularly limited, and any of resin, rubber, and the like may be used. Examples of the material of the surface layer suitably include polyvinylidene fluoride, tetrafluoroethylene copolymers, polyester, polyimide, and copolymerized nylon.

The copolymerized nylon includes any one or plural 610 nylon, 11 nylon, and 12 nylon as polymerized units, and other polymerized units contained in this copolymer include 6 nylon, nylon, and the like. Here, the ratio in which the polymerized units including 610 nylon, 11 nylon, and 12 nylon are contained in a copolymer is preferably equal to or more than 10% in total in weight ratio.

Polymeric materials may be used independently, or used in mixtures of two or more thereof. Additionally, the number average molecular weight of the polymeric materials is preferably within a range from 1,000 to 100,000, and more preferably within a range from 10,000 to 50,000.

Additionally, the resistance value may be adjusted by causing a conductive material to be contained in the surface layer. The conductive material preferably has a particle diameter of 3 μm or less.

Additionally, as conductive agents aiming at the adjustment of the resistance value, there are used those obtained by dispersing a material that conducts electricity with at least one of the electron and ion of carbon black, conductive metal oxide particles, anion conductive agent, or the like to be blended with a matrix material as a charge carrier.

Here, specific examples of carbon black of the conductive agents include "SPECIAL BLACK 350", "SPECIAL BLACK 100", "SPECIAL BLACK 250", "SPECIAL BLACK 5", "SPECIAL BLACK 4", "SPECIAL BLACK 4A", "SPECIAL BLACK 550", "SPECIAL BLACK 6", "COLOR BLACK FW200", "COLOR BLACK FW2", AND "COLOR BLACK FW2V", all of which are made by EVONIK DEGUSSA JAPAN CO. LTD.; "MONARCH1000", MONARCH1300", "MONARCH1400", "MOGUL-L", and "REGAL400R", all of which are made by Cabot Corp.; and the like.

The carbon black preferably has a pH of 4.0 or less.

As the conductive metal oxide particles that are conductive particles for adjusting the resistance value, conductive agents that are particles having conductivity, such as tin oxide, tin oxide doped with antimony, zinc oxide, anatase-type titanium oxide, and ITO, may be used if the conductive agents have an electron as the charge carrier, and are not particularly limited. These may be used singly or in a combination of two or more thereof. Additionally, although arbitrary particle diameters may be adopted, tin oxide, tin oxide doped with antimony, and anatase-type titanium oxide are preferable, and tin oxide and tin oxide doped with antimony are more preferable.

Moreover, fluorine-based or silicone-based resins are suitably used for the surface layer. Particularly, the surface layer is preferably constituted by fluorine-modified acrylate polymers. Additionally, particles may be added into the surface layer. Additionally, insulating particles such as alumina or silica, may be added to give recesses to the surface of the charging member to reduce a burden during the sliding with the photoreceptor to improve the wear resistance between the charging member and the photoreceptor.

The external diameter of the charging member as described is preferably from 8 mm to 16 mm. Additionally, as a method of measuring the external diameter, the external diameter is measured using a commercial vernier caliper or a laser type external diameter measuring device.

The micro hardness of the charging member as described is preferably from 45° to 60°. In order to make the hardness low, a method of increasing the additive amount of a plasticizer, or using a low-hardness material such as silicone rubber is considered.

Additionally, the micro hardness of the charging member may be measured by MD-1 Type Hardness Meter made by KOBUNSHI KEIKI Co., Ltd.

In addition, in the image forming apparatus related to the present exemplary embodiment, the process cartridge including the photoreceptor (image holding member), the charging device (a unit of the charging member and the cleaning member), the developing device, and the cleaning blade (cleaning device) has been described. However, the invention is not limited to this, and a process cartridge including the charging device (the unit of the charging member and the cleaning member), and besides this, one selected from the photoreceptor (image holding member), the exposure device, the transfer device and the developing device, and the cleaning blade (cleaning device) may be used, if needed. In addition, an aspect may be adopted in which these devices or members are not made into a cartridge, but are directly arranged at an image forming apparatus.

Additionally, in the image forming apparatus related to the present exemplary embodiment, the aspect in which the charging device is constituted by the unit of the charging member and the cleaning member has been described. That is, the aspect in which the charging member is adopted as the member to be cleaned has been described. However, the invention is not limited to this, and the member to be cleaned includes the photoreceptor (image holding member), the transfer device (transfer member; transfer roll), and an intermediate transfer member (intermediate transfer belt). The unit of these members to be cleaned and the cleaning member arranged in contact with these members may be directed arranged at the image forming apparatus, or similarly to the above, these members are made into a cartridge like the process cartridge, and the cartridge may be arranged at the image forming apparatus.

Additionally, the image forming apparatus related to the present exemplary embodiment is not limited to the above configuration, and well-known image forming apparatuses such as an intermediate transfer type image forming apparatus may be used.

EXAMPLES

Although the invention will be specifically described below taking examples, the invention is not limited to these examples.

Example 1

Preparation of Cleaning Roll

A double-sided tape with a thickness of 0.15 mm is stuck on a sheet of foamed polyurethane (EPM-70 made by INOAC Corporation) with a thickness of 3 mm, and a strip with a width of 10 mm and a length of 356 mm is clipped so as to have one slit with 2 mm of both the longitudinal ends being left at positions with a width of 5 mm (refer to a shape shown in FIG. 6A). Two strips connected together at both the longitudinal ends are prepared in this way.

The two obtained strips are placed on a horizontal platform so that a separate paper stuck on the double-sided tape is turned down.

Then, when the two strips are wound around a core member counterclockwise, a portion equivalent to the corner portion that faces toward the axial central portion of the core member when being wound around the core member at an end where the two strips are connected to each other is compressed using stainless steel heated from above so that the thickness of the overall corner portion (corner portion of the strips made of foamed polyurethane excluding the double-sided tape) of the strips becomes 62%.

Next, the two strips after compression are wound around a metal core member (ϕ6 in external diameter and 331 mm in total length) at a winding angle of 25° counterclockwise while giving a tension so that the strips elongate as much as about more than 0% and 5% or less in total length, and a spirally arranged foamed elastic layer is formed.

Example 2

A cleaning roll is prepared similarly to Example 1 except that a strip with a width of 15 mm and a length of 356 mm is clipped from a sheet of foamed urethane so as to have two slits with 2 mm of both the longitudinal ends being left at a distance of 5 mm in width (refer to a shape shown in FIG. 7A), and three strips connected together at both the longitudinal ends are prepared.

Example 3

A cleaning roll is prepared similarly to Example 1 except that a portion equivalent to the corner portion that faces toward the axial central portion of the core member when being wound around the core member at an end where the two strips are connected to each other is compressed using stainless steel heated from above so that the thickness of the overall corner portion (corner portion of the strips made of foamed polyurethane excluding the double-sided tape) of the strips becomes 43%.

Example 4

A cleaning roll is prepared similarly to Example 3 except that a strip with a width of 15 mm is clipped from a sheet of foamed urethane so as to have two slits with 2 mm of both the longitudinal ends being left at a distance of 5 mm in width (refer to a shape shown in FIG. 7A), and three strips connected together at both the longitudinal ends are prepared.

Example 5

A cleaning roll is prepared similarly to Example 1 except that a portion equivalent to the corner portion that faces toward the axial central portion of the core member when being wound around the core member at an end where the two strips are connected to each other is compressed using stainless steel heated from above so that the thickness of the overall corner portion (corner portion of the strips made of foamed polyurethane excluding the double-sided tape) of the strips becomes 77%.

Example 6

A cleaning roll is prepared similarly to Example 1 except that a strip with a width of 10 mm and a length of 356 mm is clipped from a sheet of foamed urethane so as to have one slit with 1 mm of both the longitudinal ends being left at a distance of 5 mm in width, and two strips connected together at both the longitudinal ends are prepared.

Example 7

A cleaning roll is prepared similarly to Example 1 except that a strip with a width of 10 mm and a length of 356 mm is clipped from a sheet of foamed urethane so as to have one slit with 2 mm of both the longitudinal ends being left at a distance of 5 mm in width and so that a portion equivalent to the corner portion that protrudes outward in the spiral direction when being wound around the core member protrudes in the longitudinal direction of the strips at an angle of 75°, and two strips (refer to a shape of FIG. 6B) connected together at both the longitudinal ends are prepared.

Comparative Example 1

Preparation of Cleaning Roll

A cleaning roll prepared similarly to Example 1 is obtained except that two strips (no end connection and compression processing) with a thickness of 3 mm, a width of 10 mm, and a length of 356 mm are prepared from a sheet of foamed urethane, and these two strips are spirally wound around the core member in a state where longitudinal sides of adhesive surfaces of the strips are brought into contact with each other.

Comparative Example 2

Preparation of Cleaning Roll

A cleaning roll prepared similarly to Comparative Example 1 is obtained except that three strips with a width of 5 mm are prepared.

Evaluation

Peeling of the foamed elastic layer of each cleaning roll is evaluated in the independent cleaning rolls prepared in the respective examples. Additionally, cleaning performance is evaluated in combinations of the cleaning rolls and the charging rolls after peeling evaluation. These results are shown in Table 1.

In addition, one prepared the following preparing method is used as the charging roll.

Preparation of Charging Roll

Formation of Foamed Elastic Layer

The below-described mixture is kneaded by an open roll and is coated on the surface of a conductive support with a diameter of 6 mm made of SUS416 into a cylindrical shape with a thickness of 3 mm, the resultant is put into a cylindrical mold with an internal diameter of 18.0 mm, is vulcanized at 170° C. for 30 minutes, is taken out of the mold, and is then polished, whereby a cylindrical conductive foamed elastic layer A is obtained.

Rubber material: 100 parts by weight (epichlorohydrin-ethylene oxide-allyl glycidyl ether copolymer rubber; Gechron 3106 made by ZEON Corporation)

Conductive agent (carbon black ASAHI THERMAL made by ASAHI CARBON Co., Ltd.): 25 parts by weight Conductive agent (KETJEN BLACK EC made by LION Corporation) 8 parts by weight Ion conductive agent (lithium perchlorate): 1 part by weight Vulcanizing agent (sulfur) 200 MESH made by TSURUMI CHEMICAL INDUSTRY Co., Ltd.: 1 part by weight Vulcanization accelerator (NOCCELER DM made by OUCHI SHINKO CHEMICAL INDUSTRIAL Co., Ltd.): 2.0 parts by weight Vulcanization accelerator (NOCCELER TT made by OUCHI SHINKO CHEMICAL INDUSTRIAL Co., Ltd.): 0.5 parts by weight Formation of Surface Layer A dispersion solution A obtained by dispersing the below-described mixture with a bead mill is diluted with methanol, the resultant is dip coated on the surface of the conductive foamed elastic layer A and is heated and dried at 140° C. for 15 minutes to form a surface layer with a thickness of 4 μm, whereby a conductive roll is obtained. This conductive roll is used as the charging roll.

Polymeric Material: 100 parts by weight (copolymerized nylon; AMILAN CM8000 made by TORAY CO.)

Conductive Agent: 30 parts by weight (antimony-doped tin oxide; SN-100P made by ISHIHARA SANGYO Co., Ltd.)

Solvent (methanol): 500 parts by weight

Solvent (butanol): 240 parts by weight

Peeling Evaluation

After the cleaning rolls prepared in the above respective examples are left for 30 days in an environment of 50° C. and 75%, peeling evaluation of the foamed elastic layers of the cleaning rolls is performed on the basis of the following criteria. In addition, the state of peeling occurrence of the foamed elastic layers of the cleaning rolls determined here shows a state where one longitudinal end portion or both longitudinal end portions of a foamed elastic layer are apart by 1 mm or more from a metal core member. Additionally, the number of locations where peeling has occurred is also investigated.

Peeling evaluation: determination criteria

A: No occurrence of peeling

B: Occurrence of peeling (Evaluation of Cleaning Performance)

The cleaning rolls after the peeling performance is carried out are mounted within a drum cartridge for a color copier DocuCentre-IV C2260 made by FUJI XEROX Co., Ltd similarly to the charging rolls along with the charging rolls prepared in the examples, and evaluation tests of the cleaning performance of axial ends and portions other than the ends are performed.

In the evaluation tests, after printing is performed on 100,000 sheets of A4, halftone images with a density of 30% are output, and the density unevenness (cleaning performance) caused by the uneven cleaning of the charging rolls is evaluated on the basis of the following criteria.

Cleaning Performance: Determination Criteria

A: No occurrence of density unevenness in image

B: Allowable level although density unevenness occurs slightly in image

C: Unallowable level at which density unevenness occurs in image

TABLE 1

| | Foamed Elastic Layer (Strip) | | | | Evaluation | | | |
|---|---|---|---|---|---|---|---|---|
| | | | | | Peeling | | Cleaning Performance | |
| | Number of Strips | Presence of End Connection (mm (Width of Strip Connecting Portion/Mean Cell Diameter of Foamed Elastic Layer) | Contact Area Ratio | End Processing | Presence of Occurrence | Number of Locations of Occurrence | End | Other Than End |
| Example 1 | 2 | Yes (2.0 mm(Width of Strip Connecting Portion)/0.4 mm (Mean Cell Diameter) | 40% | Compression Processing | A | 0 | A | A |
| Example 2 | 3 | Yes (2.0 mm(Width of Strip Connecting Portion)/0.4 mm (Mean Cell Diameter) | 40% | Compression Processing | A | 0 | A | A |
| Example 3 | 2 | Yes (2.0 mm(Width of Strip Connecting Portion)/0.4 mm (Mean Cell Diameter) | 88% | Compression Processing | A | 0 | A | A |
| Example 4 | 3 | Yes (2.0 mm(Width of Strip Connecting Portion)/0.4 mm (Mean Cell Diameter) | 88% | Compression Processing | A | 0 | A | A |
| Example 5 | 2 | Yes (2.0 mm(Width of Strip Connecting Portion)/0.4 mm (Mean Cell Diameter) | 33% | Compression Processing | A | 0 | A | A |
| Example 6 | 2 | Yes (1.0 mm(Width of Strip Connecting Portion)/0.4 mm (Mean Cell Diameter) | 40% | Compression Processing | A | 0 | A | A |
| Example 7 | 2 | Yes (2.0 mm(Width of Strip Connecting Portion)/0.4 mm (Mean Cell Diameter) | 40% | Compression Processing | A | 0 | A | A |
| Comparative Example 1 | 2 | None | 23% | None | C | 4 | C | A |
| Comparative Example 2 | 3 | None | 23% | None | C | 6 | B | A |

It can be understood from the above results that, in the present example, occurrence of peeling is suppressed and end cleaning performance is also maintained compared to the comparative example.

In addition, in Example 5, end peeling of the foamed elastic layer is slightly seen when the same peeling evaluation is further performed after the above peeling evaluation.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaning member for an image forming apparatus comprising:

a core member;

a foamed elastic layer comprising two or more strip-shaped foamed elastic members (i) that are connected together at one or both of longitudinal end portions and (ii) that are spirally wound around the outer peripheral surface of the core member from one end of the core member to the other end thereof, wherein a space is defined between the two or more strip-shaped foamed elastic members; and two or more adhesive layers with the space defined therebetween, wherein the two or more adhesive layers bond the two or more strip-shaped foamed elastic members to the core member.

2. The cleaning member for an image forming apparatus according to claim 1, wherein the area of a region that comes into contact with the outer peripheral surface of the core member via the adhesive layer in the surface that faces the outer peripheral surface of the core member in a corner portion that faces toward an axial central portion of the core member or a corner portion that protrudes outward in the spiral direction of the foamed elastic layer, at an end where the two or more strip-shaped foamed elastic members that become the foamed elastic layer are connected to each other, is approximately equal to or more than 40% in a contact area ratio per unit area.

3. The cleaning member for an image forming apparatus according to claim 1, wherein compression processing is performed in the thickness direction of the foamed elastic layer on a corner portion that faces toward an axial central portion of the core member or a corner portion that protrudes outward in the spiral direction of the foamed elastic layer, at an end where the two or more strip-shaped foamed elastic members that become the foamed elastic layer are connected to each other.

4. The cleaning member for an image forming apparatus according to claim 1, wherein the width of a connecting portion where the two or more strip-shaped foamed elastic members that become the foamed elastic layer are connected to each other is approximately equal to or more than twice a void diameter of the strip-shaped foamed elastic members.

5. A charging device comprising:

a charging member that charges a member to be charged; and a cleaning member that is arranged in contact with the surface of the charging member and cleans the surface of the charging member and is used for an image forming apparatus according to claim 1.

6. A process cartridge attached to and detached from an image forming apparatus, comprising at least:

the charging device according to claim 5.

7. An image forming apparatus comprising:

an image holding member;

a charging unit that charges the surface of the image holding member and includes the charging device according to claim 5;

a latent image forming unit that forms a latent image on the surface of the charged image holding member;

a developing unit that develops the latent image formed on the image holding member with toner to form a toner image; and a transfer unit that transfers the toner image to a member to be transferred.

8. A unit for an image forming apparatus comprising:

a member to be cleaned; and a cleaning member that is arranged in contact with the surface of the member to be cleaned and cleans the surface of the member to be cleaned and is used for an image forming apparatus according to claim 1.

9. A process cartridge attached to and detached from an image forming apparatus, comprising at least:

the unit for an image forming apparatus according to claim 8.

10. An image forming apparatus comprising:

the unit for an image forming apparatus according to claim 8.

* * * * *